United States Patent [19]

Baierl

[11] Patent Number: 4,742,665

[45] Date of Patent: May 10, 1988

[54] METALLIC SPATIAL FRAMEWORK STRUCTURE COMPOSED OF SINGLE ELEMENTS FOR ERECTING BUILDINGS

[75] Inventor: Josef Baierl, Pähl, Fed. Rep. of Germany

[73] Assignee: Baierl & Demmelhuber GmbH & Co. Akustik & Trockenbau KG, Pähl, Fed. Rep. of Germany

[21] Appl. No.: 46,581

[22] Filed: May 6, 1987

Related U.S. Application Data

[63] Continuation of Ser. No. 855,815, Apr. 21, 1986, abandoned.

[30] Foreign Application Priority Data

Aug. 20, 1984 [DE] Fed. Rep. of Germany ..... 3430612
Aug. 20, 1985 [WO] PCT Int'l Appl. ... PCT/EP85/00425

[51] Int. Cl.[4] ..... E04B 1/00

[52] U.S. Cl. ..... 52/276; 52/404; 52/775; 52/648

[58] Field of Search ..... 52/404, 648, 775, 275, 52/276, 278, 279, 280

[56] References Cited

U.S. PATENT DOCUMENTS

| | | | |
|---|---|---|---|
| 1,729,743 | 10/1929 | Jorgensen et al. | 52/648 |
| 3,332,170 | 7/1967 | Bangs et al. | 52/404 |
| 4,107,893 | 8/1978 | Rensh | 52/775 |

*Primary Examiner*—Carl D. Friedman
*Assistant Examiner*—Creighton Smith
*Attorney, Agent, or Firm*—Dennison, Meserole, Pollack & Scheiner

[57] ABSTRACT

A statically self-supporting spatial framework structure for prefabricated buildings. A plurality of metal components are arranged in spaced relationship and provide supports for inner and outer walls or skins to eliminate thermal bridges between the inner and outer walls preclude heat transfer therebetween.

7 Claims, 11 Drawing Sheets

METALLIC SPATIAL FRAMEWORK STRUCTURE COMPOSED OF SINGLE ELEMENTS FOR ERECTING BUILDINGS

This application is a continuation of application Ser. No. 855,815, filed Apr. 21, 1986 now abandoned.

FIELD OF THE INVENTION

The present invention relates to a spaced metal framework structure which is composed of individual elements for erecting buildings. Such framework structures made from metal components for prefabricated buildings with reproduced timber frameworks are already known. Such a suggestion may, for example, be taken from the German publication DE-OS No. 31 30 427. Another arrangement is disclosed in U.S. Pat. No. 4,205,497.

While building framework structures which are made of wood provide some thermal insulation between the outer and inner wall surfaces or skins by means of the material used, the metal skeleton prefabricated buildings wherein the timber framework structures are substantially replaced by metal components had the disadvantage of forming thermal bridges between the inner and the outer wall surfaces and adversely affecting the climate control system's ability to provide an acceptable range of interior temperatures. Only in relatively mild climates can the known prefabricated buildings with a metal framework be used economically.

SUMMARY OF THE INVENTION

An object of the present invention is, therefore, to provide a metal skeleton framework having good insulation qualities which are adaptable for use in substantially all building type and building plan variations.

The invention is directed to components for and the method of construction wherein only the skeleton has a static function.

The invention contemplates including a metal skeleton which overcomes the major problems arising from inner and outer thermal differences by means of the fundamental separation of the outer and the inner skin of the building. This concept is particularly applicable to thermal insulation and protection as well as for the reduction of tension and of condensation. The skeleton employs a minimal number of individual types of components and in many instances is limited to three basic element and profile types thus permitting an efficient prefabrication in a manufacturing plant, and facilitating transport to the place of use at a substantial reduction in cost.

The skeleton is composed of several metal sheet profiles which may be produced uniformly. These uniform profiles may be arranged with respect to each other in order to meet whatever static requirements are necessary without having to maintain an inventory of profiles which are statically different in their load-bearing properties.

DESCRIPTION OF DRAWINGS

Further details, characteristics and advantages of the invention will be recognized from the following description of an embodiment with variations as illustrated in the drawings in which:

FIG. 5 is a cross-sectional view of a part of the wall;

DESCRIPTION OF THE PREFERRED EMBODIMENT

A spatial framework structure skeleton is formed of a plurality of metal profiles constituting elements. A bearing element is a vertical support beam which, depending on its position within the spatial framework, is differentiated as an outer wall support beam 10 or 40 and as inner wall support beam 50. Each of them is, however, most advantageously composed of four identical single profiles 14 or 15.

Figure 1:
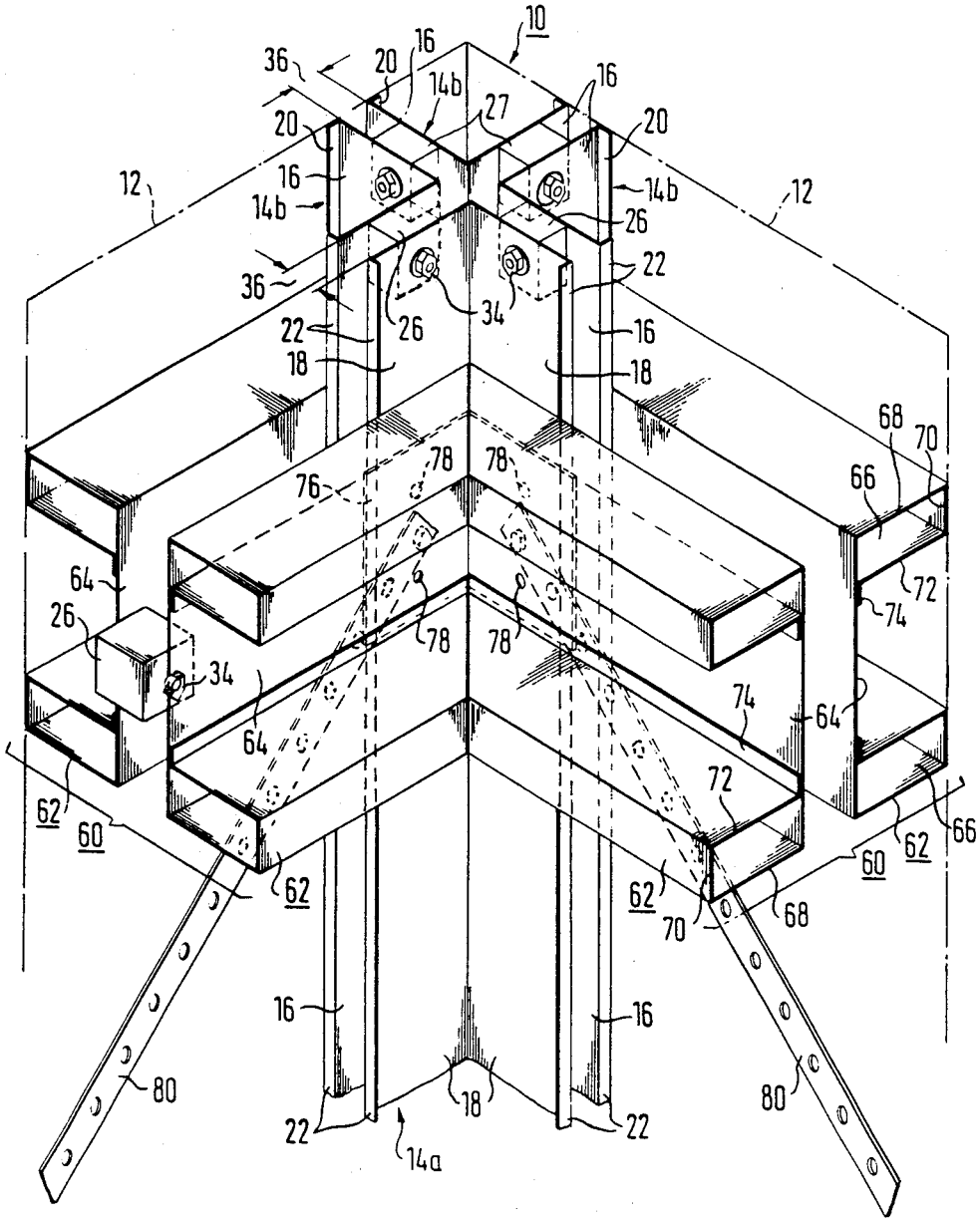
FIG. 1 is a fragmentary schematic perspective view of the invention as employed as a corner of the building.

A house corner with an outer wall corner support beam 10 may be seen in FIG. 1 in the form of an angle composed of four equal single profiles which are, in this case, composed of an inner profile 14*a* and three outer profiles 14*b* of the same configuration. In the illustrated example, the profiles have side surfaces 16 and 18 which terminate in lips 20 and 22. The sides 16 are in the outer wall and the sides 18 are in the inner wall area. The lips 20 and 22 serve to reinforce the profiles 14*a* and 14*b* and the outer lips 20 provide a surface to attach the outer skin 12 of the building.

Figure 2:
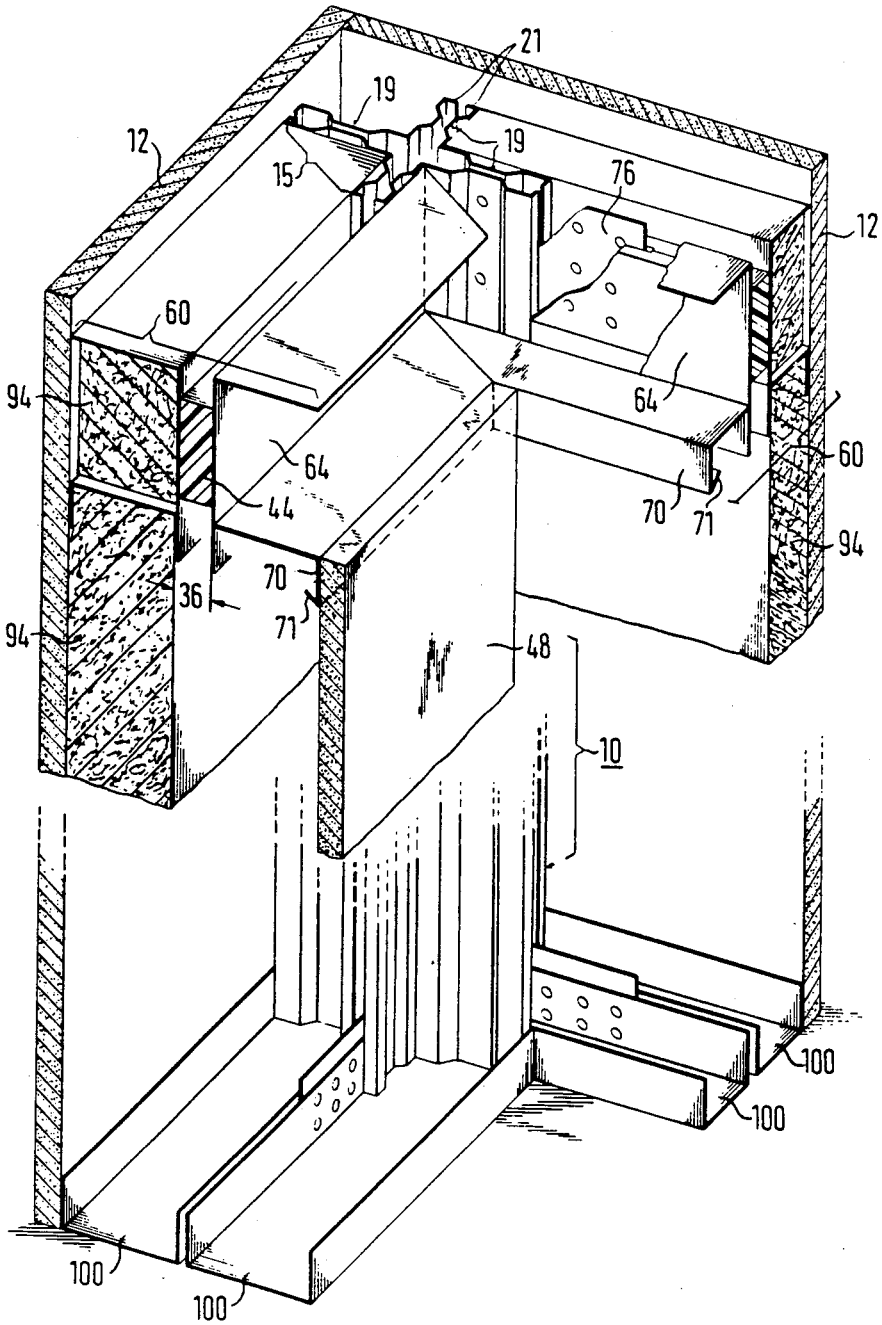
FIG. 2 shows a variation of the support beam illustrated in the embodiment shown in FIG. 1.
Figure 2A:
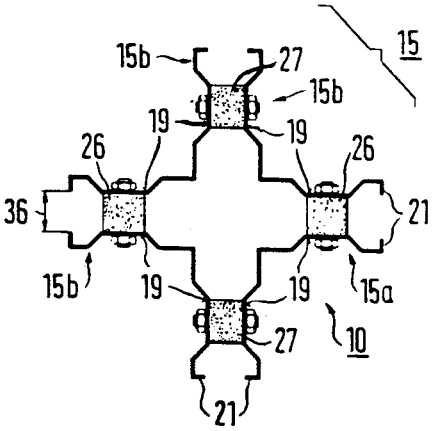
FIG. 2*a* is a vertical section of the support beam according to FIG. 2.
Figure 4A:
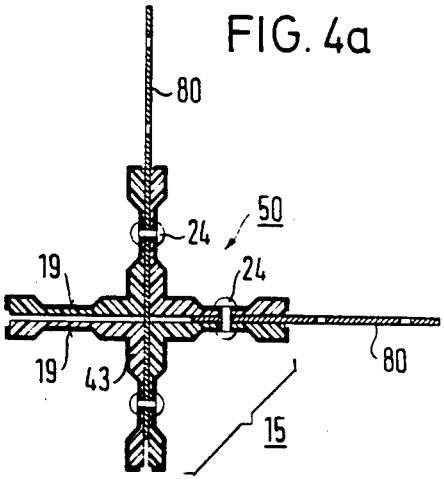
FIG. 4*a* is a cross-section of an inner wall support beam with a profile varied according to FIG. 2.

FIGS. 2 and 2*a* are more detailed illustrations of one of the embodiments of the support beam 10 with the angle profile 15. The variation lies in that the angle side 15 includes a groove 19 which is inwardly drawn toward the interior of support beam 10. A spacer 26 or 27 which is further described below is positioned adjacent the groove 19 so that a fastener positioned within the groove 19 does not interrupt a smooth side supporting surface for the horizontal beams 60 with their webs 64. The principle is the same when both angle profile elements 14 and 15 are used.

Support beam 10 is composed of four equal individual elements 14*a*, 14*b*, 15*a* and 15*b* so that a distinct space 36 is defined between the facing sides 16 and 18. This space 36 is particularly important between the sides 16 of an exterior profile 14*b* or 15*b* and the complementary sides 18 of an interior profile 14*a* or 15*a*. All metallic contact between the sides 16 and 18 is avoided by space 36. Therefore, all metallic thermal bridges between the elements are eliminated.

Figure 5A:
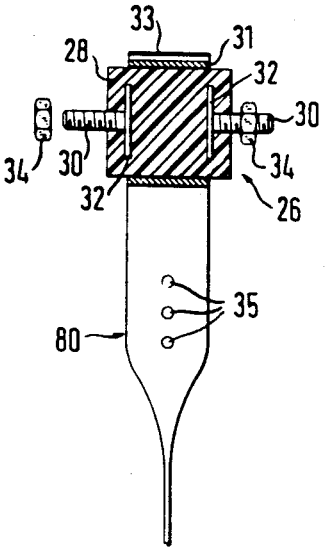
FIGS. 5*a* and 5*b* are sectional views of a detail of FIGS. 1 and 2*a* in two different planes.
Figure 5B:
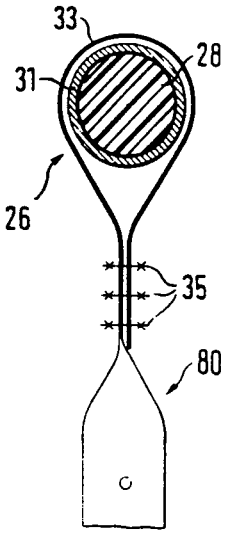

FIGS. 5*a* and 5*b* illustrate in detail the possibilities for this particular feature. An example of the embodiment illustrates here how a mechanical connection which, on the one hand, avoids thermal flow in the connecting material is, on the other hand, able to provide good mechanical connection and stability. The illustrated example of the embodiment discloses, in the inner part of both drawings, a releasable mechanical connection 26 which may be used wherever the outer elements are to be kept at the desired distance 36 from the inner elements of the building.

This connection 26 consists of a non-metallic insulating body 28 without thermal conductivity and of sufficient stability. The body can be a hard rubber or plastic material. In addition to thermal benefits, there is also improved sound-proofing and the material should also have some elasticity. Suitable mechanical connecting elements, for example bolts and nuts, are embedded in axial alignment to one another in insulating body 28. The bolts 30 include a head 32 which is positioned in the interior of the insulating and spacer body 28 and can be a simple radial extension or a star-shaped plate, or the like. Each of the bolts 30 are spaced from one another in the insulating and spacer body 28 in order to avoid all thermal flow. The bolts 30 are intended to project through corresponding openings in the sides 16 and 18 and the final connection is achieved by mounting nuts 34 thereon. Other releasable or non-releasable connections can be provided if desired instead of the bolt and nut arrangement. It is, for example, possible to provide hollow rivets or other similar connecting elements instead of the screw bolts.

The insulating spacers 26 according to FIGS. 5*a* and 5*b* are arranged in the corners of the building and in the outer wall support elements to avoid thermal flow between the outer members which are parallel to the outer skin 12, for example, the sides 16, and the inner members, for example, sides 18, and they are arranged so that they are, for example, one above another in a corner support beam 10. In order to save costs, simple and pure metallic spacers 27 can be used between the sides 16 which are perpendicular to the outer skin 12. There is no need for avoiding thermal flow in this area as both sides 16 are within the same outer area of the spatial framework structure anyway. A variety of diagonal tension member connections 80 are illustrated in FIGS. 5*a* and 5*b*. These can only be used at the indicated connection points. Only a few of the diagonal tension member connections are thus really used. This further embodiment is described in more detail in connection with the diagonal tension members. Only the inner part of the spacer 26 without the looped diagonal tension member 80 is of importance for most of the connection points according to FIGS. 5*a* and 5*b*.

Figure 3:
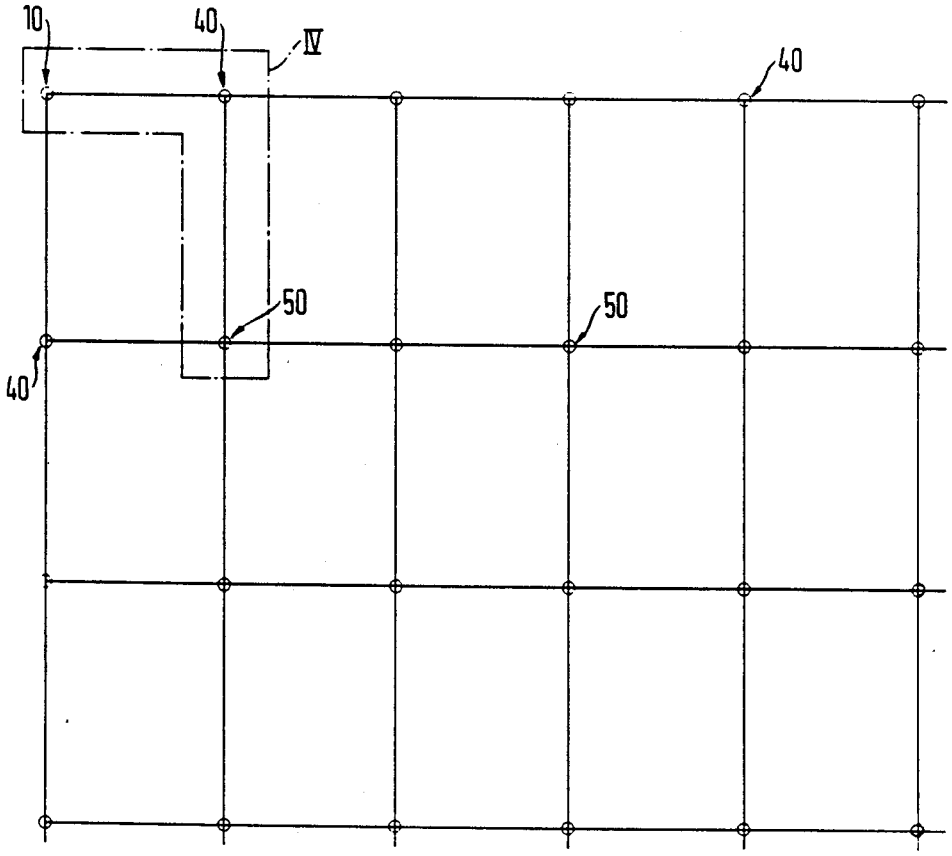
FIG. 3 is a schematic cross-section of a ceiling plane.

As can be seen in the schematic illustration in FIG. 3, it is possible to have three different support beams in the cross-section. The support beam 10 which has already been described in detail in the earlier part of the description is an external building corner. Neighboring support beams 40 are situated in the plane between the outer and inner skin and different support beams 50 are in the interior of the building. The section marked in FIG. 3 is shown in more detail in FIG. 4.

Figure 4:
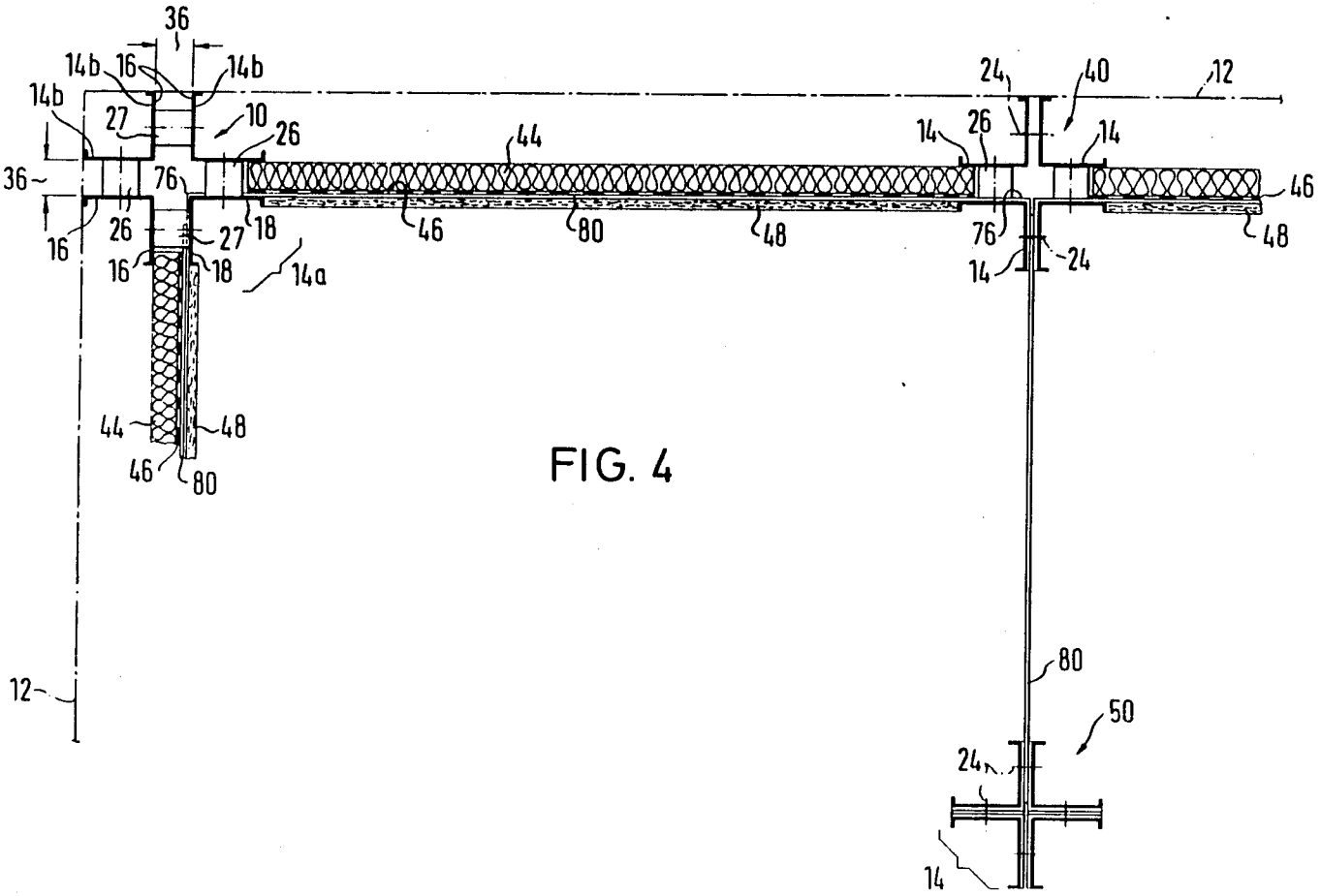
FIG. 4 is schematic cross-section and plan view of the part labelled "IV" in FIG. 3 with support beams in the inner and outer wall areas.

The elements of the support beam 10 which have already been mentioned are on the left at the top of FIG. 4. A further support beam 40 is situated toward the outer skin 12 at a distance. It must be noted here that the illustrations according to FIGS. 3 and 4 are not scale diagrams of an actual building but schematic illustrations of a principle.

Support beam 40, like support beam 10, is also composed of four equal profile elements 14. While support beam 10 in the corner of the building has a distance 36 in two planes or outer walls which cross at right angles and is therefore kept at a distance in each connecting plane of the elements 14, in support beam 40 the distance must only be kept parallel to the outer skin 12 by inserting the insulating spacer elements 26 in the aforementioned manner. The sides of the profiles 14 can be set directly above one another and connected to each other in the connection plane by means of simple connecting elements 24. A support beam 50 which is totally in the interior of the building is constructed with sides directly joined by connectors 24, as can be seen in FIG. 4. Both support beams 40 and 50 are connected statically to a diagonal tension element 80 in addition to the horizontal main support beams which are not shown in this drawing.

An inner support beam 50 which comprises profile angles 15 which are connected directly and without spacing by means of fasteners to the grooves 19. Fasteners are disclosed in the additional illustration of FIG. 4. Like any of the other elements, the support beam 50 can be filled with insulating material 43.

An insulating filling 44 made of suitable insulating material which has a vapor-proof layer can be provided everywhere and above all, in the space determined by distance 36. This lining of the prefabricated house is usual and is only mentioned here for reasons of completeness. The closing of wall composition with pressboard insulation material 48 is also known.

Figure 6:
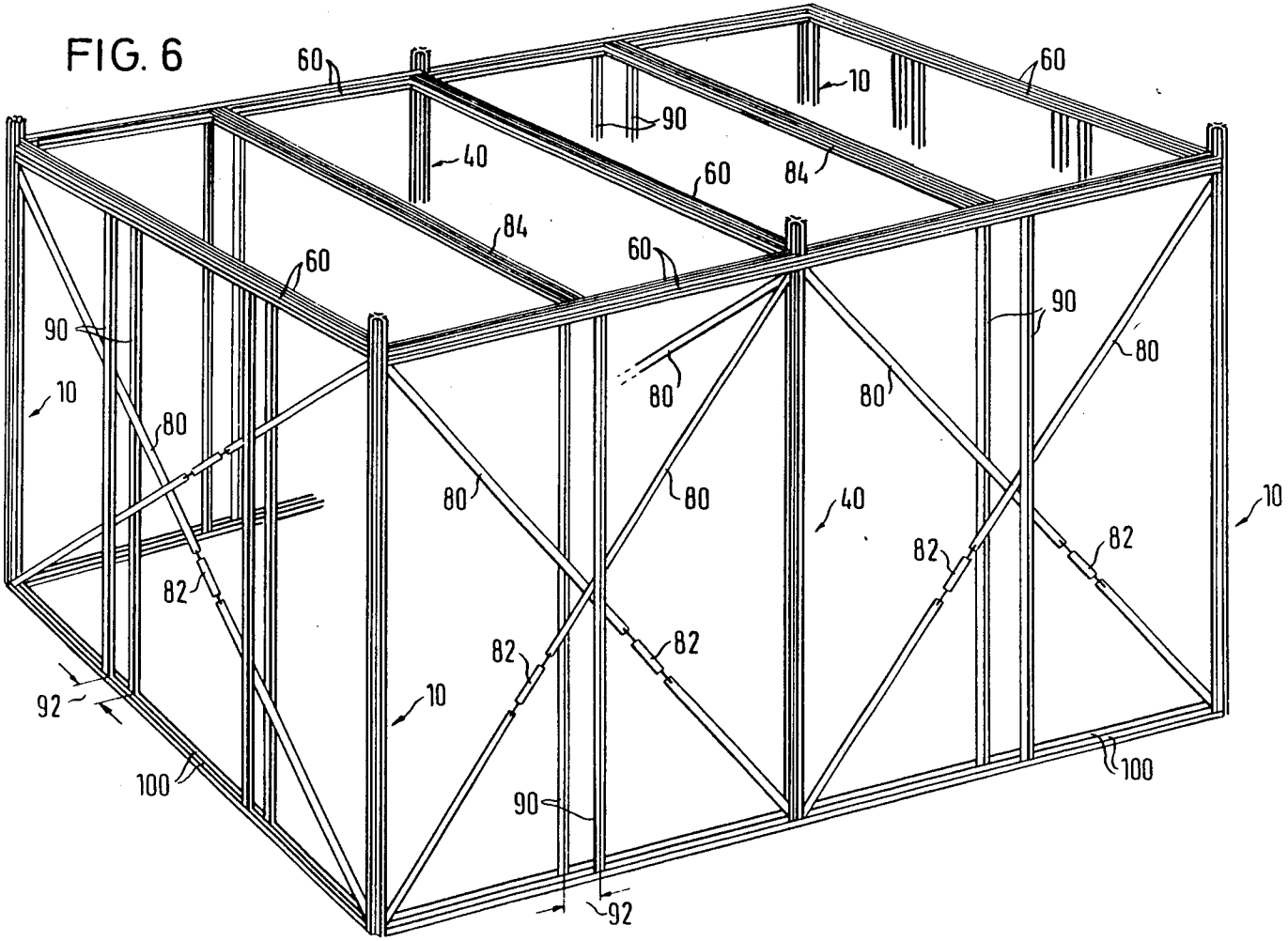
FIG. 6 is a perspective schematic of a spatial framework structure composed of individual elements.

FIG. 6 shows a schematic perspective view of a completely constructed spatial framework structure and elucidates those planes which are additionally built in.

Figure 7:
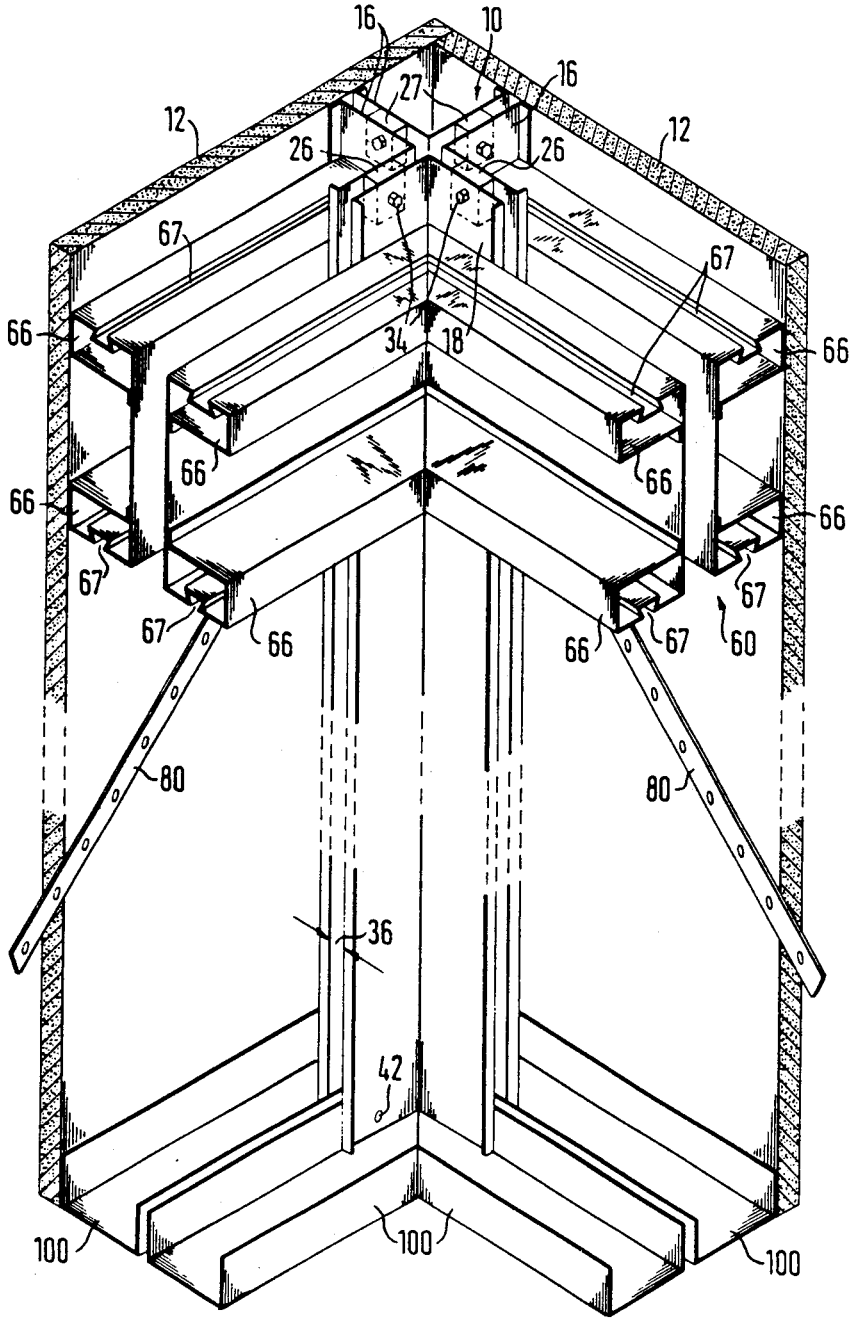
FIG. 7 is a fragmentary perspective variation of the embodiment illustrated in FIG. 1.

The bottom parts of all of the vertical support beams 10, 40 in the wall area are in plates 100 which, according to FIG. 7, in correspondence with the distance 36 are designed so that all of the feet 42 of the support beams 10, 40 can be adjusted and suitably connected to the sides of the preferred U-profile-shaped plates 100. Tension members, which straighten the spatial framework structure upon the tightening of tension locks 82 and ensure that the angles remain the same, are diagonally extended between the neighboring support beams 10 and 40 in the space labelled as distance 36. The space which is in every outer wall and is labelled as distance 36 not only permits an advantageous strict separation of the outer wall from the inner wall construction, but also leaves a suitable free space for diagonal bracing. The use of perforated flat strip material is preferable for diagonal bracing.

The following description refers particularly to the illustration of FIGS. 6-10. Particulars of preceding figures which have not yet been discussed in detail are also partially dealt with at this point.

Vertically inserted division profiles 90, as shown in FIGS. 6, 8, 9 and 10, are between the support beams 10, 40 or 50 which each consist of four individual elements and, on the one hand, give sufficient support to soft lining material 94 which may be optionally used and, on the other hand, offer additional static support so that energy entering the framework wall from the ceiling via cross beams may be conducted away, as will later be elucidated. Furthermore, additional fixing surfaces are provided for the inner or outer skin. According to the invention, these division profiles 90 are inserted in pairs in the plates 100 along an outer wall so that a distance 92 (FIGS. 6, 8, 9 and 10) is maintained in the direction of the longitudinal axis of each outer wall 12. This distance 92 prevents the formation along the outer wall lattice of heat bridges which are created by too closely positioned metal cross sections of the division profiles 10 which cross through the insulating material 94 or perpendicularly to the outer wall lattice through the air layer therein.

On the upper part of the support beams 10, 40 and 50 where the diagonal bracings 80 can be inserted in fixing openings 78, there is a connection, with or without an additional connecting angle 76, for a horizontal support beam 60 which covers the entire length of each side and which is composed of angular profiles 62 which are arranged in pairs according to FIG. 1. Each profile 62 has a vertical web 64 which is folded to a box profile 66 at the upper and lower end. For this purpose, the web 64 is bent at a right angle to form a flange 68 which is bent back to form an outer web 70 parallel to the plane of web 64. The box profile 66 is finally completed by cross flange 72 with edge 74. Such a profile 62 can be folded in one working step and offers a sufficient degree of static stability. Here, the connection between edge 74 and the web may be left open. Mechanical improvements in the moment of resistance of support beam may also be obtained by punching points or by spot welds. This may be done easily during the production of the profiles so that an increase in stability does not result in any particular difficulties in manufacture.

Uniformly constructed side support beams 84 which have a smaller cross-section may be inserted into the main support beam 60 in order to form a storey ceiling. The main and side support beams may, however, also be designed, according to a variation of FIGS. 2 and 8, so that with small loads, the U-sides terminate in outer webs 70 and only have a drawn-in edge 71. The drawn-in edge 71 is thus given a suitable direction for holding inserted insulating material.

When connecting the horizontal main support beams 60 and the support beams 10, 40 and 50, the webs 64 are connected at storey level to the outer sides 16 and to the inner sides 18 of support beams 10 and 40, whereby a distance labelled distance 36 is kept between the webs 64 of the same support beam 60. This guarantees the separation of the inner and the outer wall in the area of the horizontal support beams and thermal bridges of any kind are avoided.

If, for static reasons, a mechanical connection between neighboring webs 64 is necessary, then insulating spacers 26 may be employed, as illustrated on the left-hand side of FIG. 1. Unlike the illustration in FIG. 5*b*, these spacers 26 usually have flat faces and are not a round shape. The drawings illustrate a variety of shapes for the spacers and several techniques for attaching the tension band 80. The insulating body 28 may be encircled by a sleeve 31, around which the looped end 33 of the diagonal tension member 80 is positioned. The loop 33 is then closed with appropriate fixing means 35. Thus, connecting points for the diagonal tension member 80, in those instances where they are used, are at the points where the spacers are employed. This arrangement will accommodate the static load and provide the required reinforcement. In some instances, it would not be necessary to provide crossing diagonal tension members within each filed between the support beams 10, 40 and 50.

Figure 8:
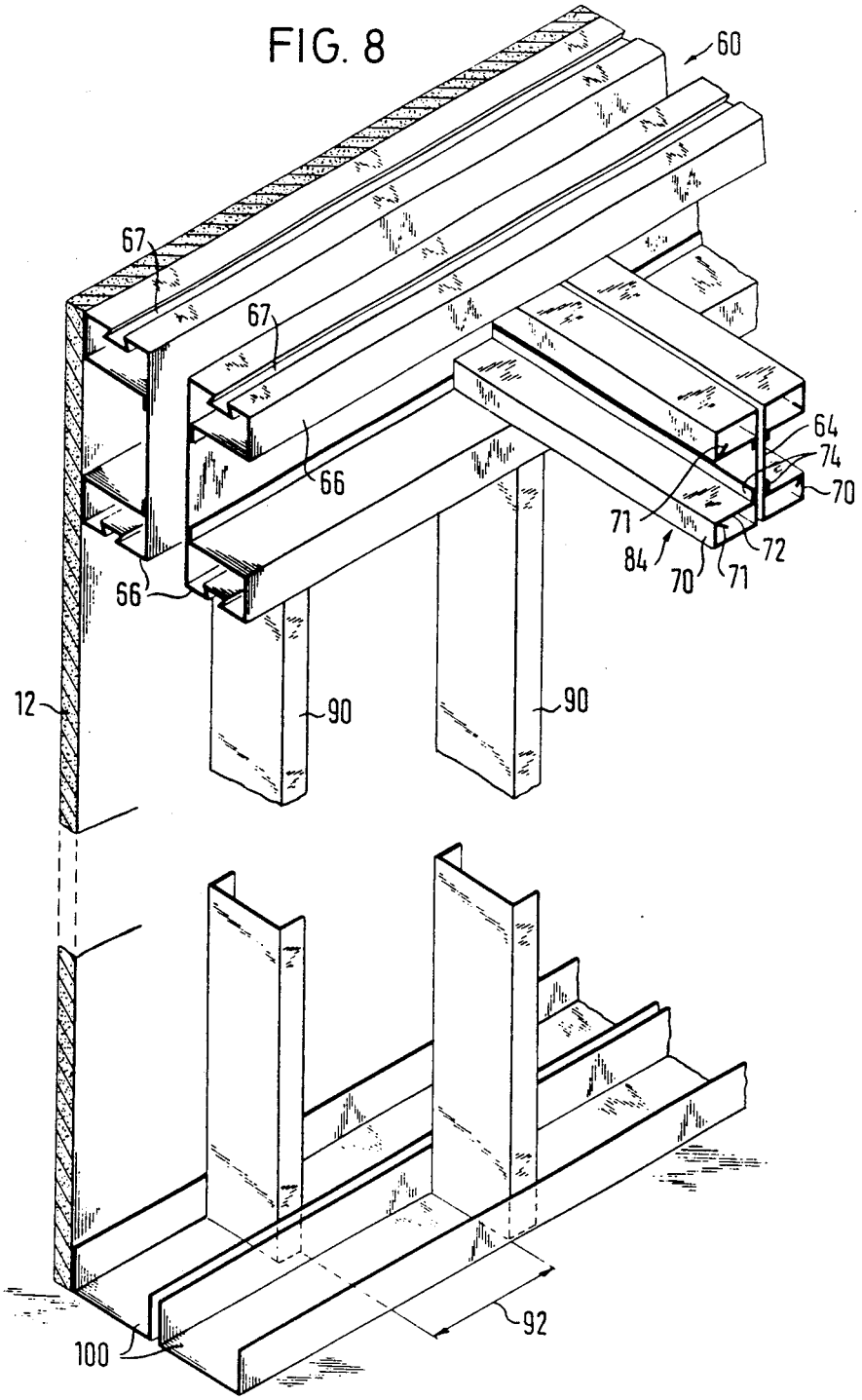
FIG. 8 is a fragmentary detail of the anchoring of a ceiling support arranged between the support beams.
Figure 9:
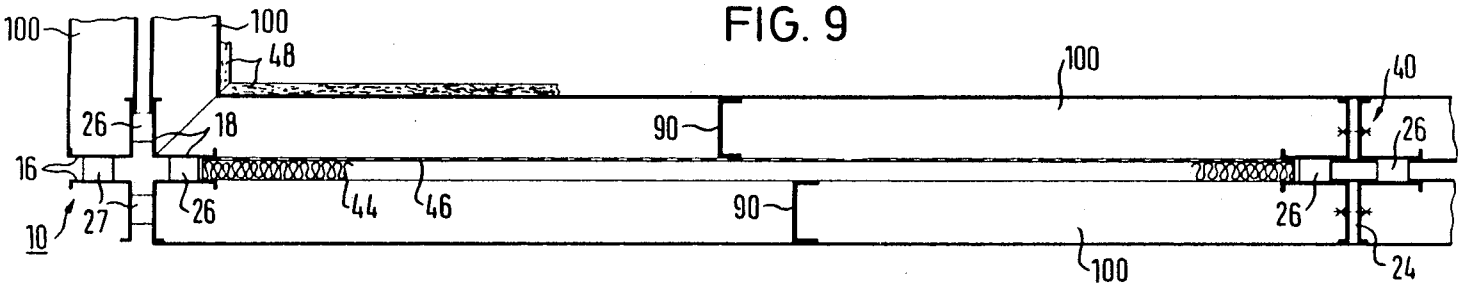
Figure 10:
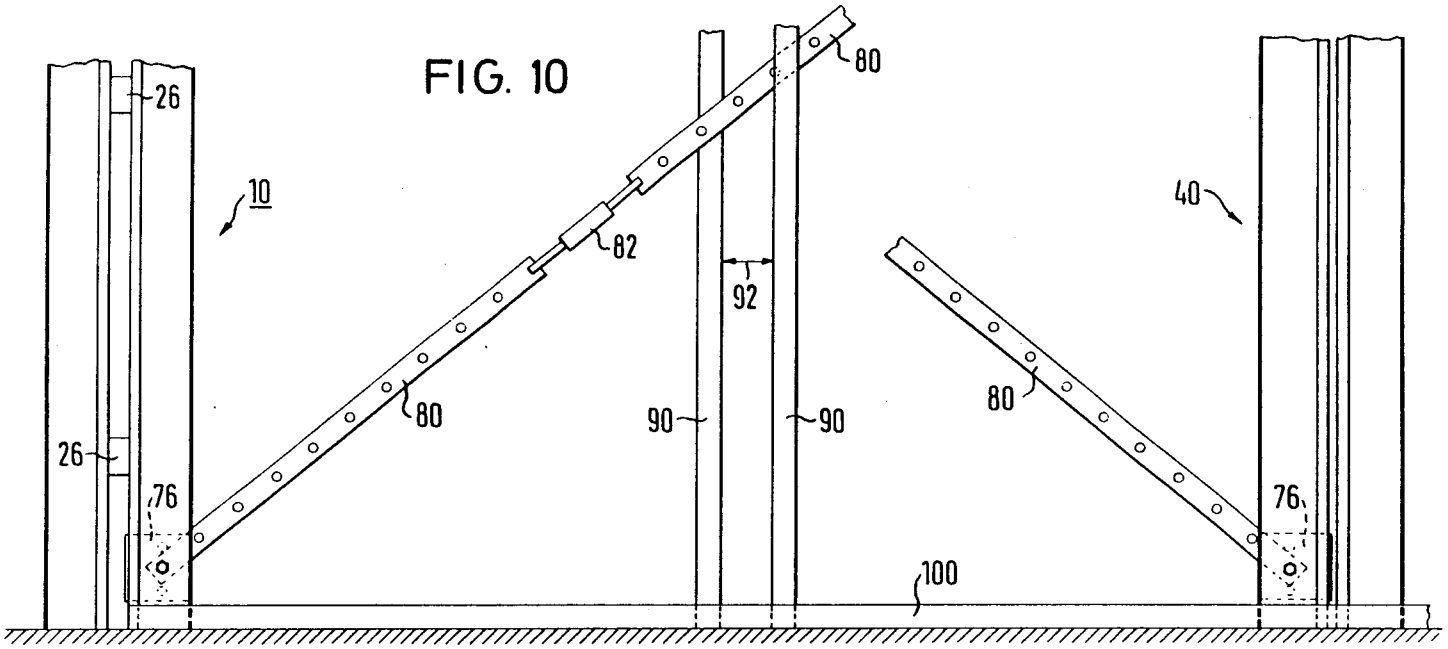
FIG. 10 is an elevation of the same wall section.

In order to further improve the rigidity of the spatial framework structure, the box-shaped profile 66 may be provided with a dovetail-shaped or otherwise shaped longitudinal groove 60 according to FIGS. 7 and 8. Web 64 of the inner profile 62 can be connected to the inner side 18 of support beams 10 or 40 and to the outer side 16 of support beams 10 or 40 so that the distance 36 between the parts of the main support beam is maintained.

In order to form a support storey ceiling according to FIG. 8, side support beams 84 which correspond to the main support beam 60 in their constructional form and which are assembled in the suitable scale and also connected to the main support beams 60 are inserted between the inwardly directed sides 66 of the horizontal main support beam 60.

Single or multi-storeyed buildings can be erected in this way whereby the support beams 10, 40 and 50 are continued upwardly in their axes.

Figure 11:
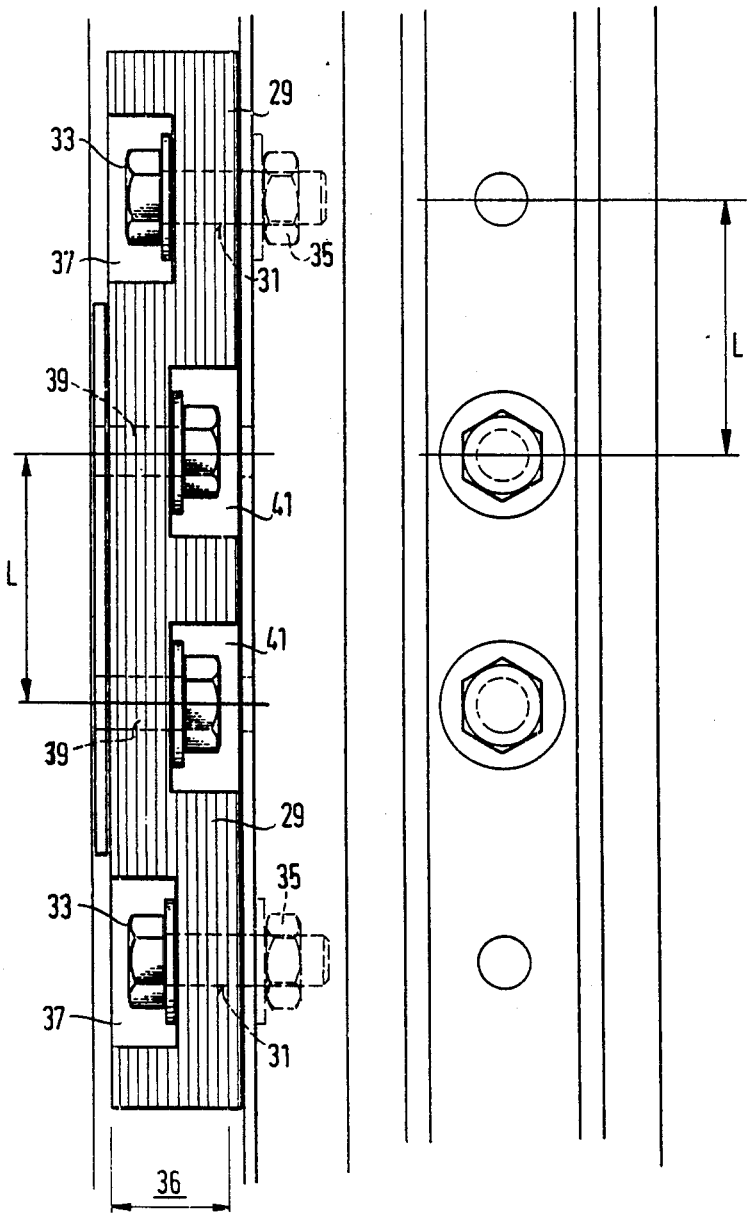
FIGS. 11 and 12 are modified examples of an embodiment of an insulating range spacer.
Figure 12:
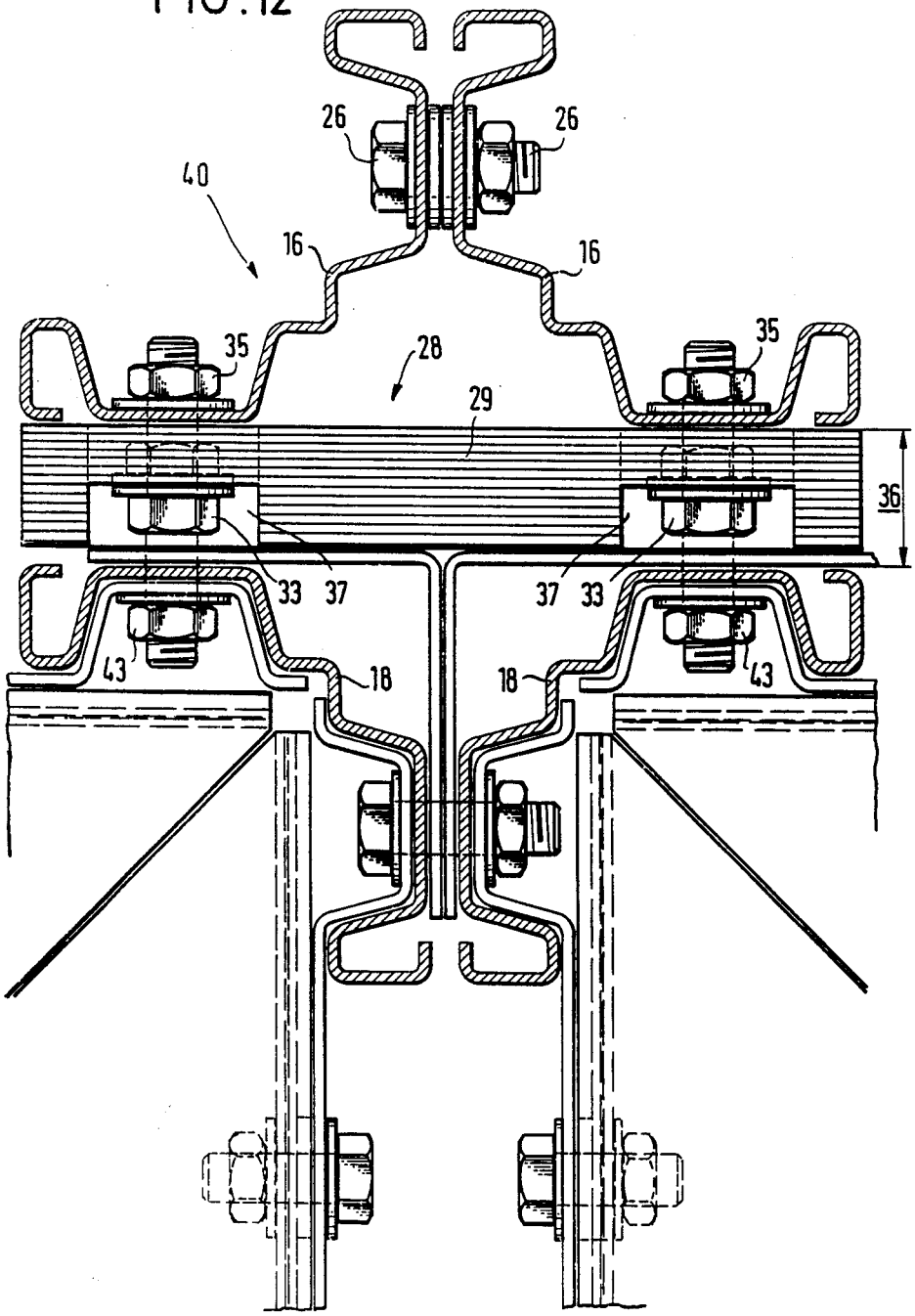

FIGS. 11 and 12 show a further modified example of an embodiment of the insulating body 28 where the outer parts are separated from the inner parts without transferring heat and still having sufficient strength. A modified range spacer 28*a* can be inserted in the vertical projection according to FIG. 11 or in the horizontal projection according to FIG. 12 in the area of the outer skin supports. FIG. 11 may also be seen as an example for the connection in the horizontal support beam area. Range spacer 28*a* consists of a plywood covering and is inserted in the distance 36 between each of the metal parts between the outer wall 12 region and the inner wall region.

In practice, the metal parts are provided with holes in a line in a strictly determined distance "L" of, for example, 60 mm. Accordingly, the panel 29 is also perforated in the distance "L". A bolt 33 is pressed through a bore 31 and connected to a nut 35 on the outer side, whereby the screw head of the bolt 33 is positioned in a clearance 37. Moved in the distance "L", another bolt 39 is put through a clearance 41 from the other side with its bolt head so as to be provided with a nut 43 (FIG. 12). This sequence can be continued. In this case, all points of heat transfer are easily avoided.

The screws or bolts are arranged in relation to one another in the given hole marked L. The result, however, is a rigid structure.

I claim:

1. A metallic spatial framework structure for a building, or the like, comprising a plurality of individual framing elements including vertical and horizontal components, said vertical components each being of a first substantially identical configuration and said horizontal components each being of a second substantially identical configuration different from said vertical components, spacer means positioned between said various components to maintain selected components in spaced relation when assembled and without metallic interconnection between said selected components to establish a thermal barrier between said selected components in both the vertical and horizontal configuration, inner and outer skins attached to selected vertical and horizontal components to establish inner and outer walls for said building spaced from each other and defining an air space therebetween, said vertical components being arranged in a spaced cruciform configuration with said spacer elements positioned therebetween and connected at opposite ends to said spaced vertical components, said horizontal components being arranged in parallel horizontal pairs directly connected to selected ones of said vertical components and indirectly to selected other vertical components through the medium of said spacer means, each of said horizontal and vertical components being configured when assembled to provide supporting surfaces for attachment of said inner and outer skins.

2. The invention defined by claim 1 wherein said vertical components each include four metallic elements each of generally right angle configuration arranged in spaced relation to define in cross-section a cruciform.

3. The invention of claim 2 wherein said horizontal components each include a spaced pair of horizontal elements of substantially identical configuration and each element is connected to selected portions of said vertical components and wherein said vertical and said horizontal components each include means to support said inner and outer skins.

4. The invention of claim 1 wherein said spacers are formed of thermally insulative material and include a spaced pair of generally coaxial and oppositely directed fastening means partially embedded within said insulative material and including portions extending outwardly therefrom for connection to selected ones of said framing elements.

5. The invention of claim 4 wherein said fastening means are bolts and nuts.

6. The invention of claim 1 wherein adjustable tension members extend diagonally between selected vertical components.

7. The invention of claim 6 wherein said tension members include means to attach each end of said tensioning member to a spacer positioned between the elements forming said vertical components.

* * * * *